US006016591A

United States Patent [19]

Strudel et al.

[11] Patent Number: 6,016,591

[45] Date of Patent: Jan. 25, 2000

[54] METHOD AND APPARATUS FOR TREATING TUBULAR KNITTED GOODS

[75] Inventors: Werner Strudel, Friedrichshafen; Guenter Euscher, Sigmarszell; Oliver Hostenkamp, Lindau, all of Germany

[73] Assignee: Lindauer Dornier Gesellschaft mbH, Lindau, Germany

[21] Appl. No.: 09/300,352

[22] Filed: Apr. 27, 1999

[30] Foreign Application Priority Data

Apr. 29, 1998 [DE] Germany ..... 198 19 051
Mar. 22, 1999 [DE] Germany ..... 199 12 754

[51] Int. Cl.[7] ..... D06C 5/00; D06C 7/00

[52] U.S. Cl. ..... 26/81; 26/106

[58] Field of Search ..... 26/80, 81, 83, 26/84, 85, 106; 68/5 A, 5 B, 5 D, 28; 34/380, 385, 391, 395, 429, 439, 440, 62, 103, 104, 105

[56] References Cited

U.S. PATENT DOCUMENTS

| | | | |
|---|---|---|---|
| 3,909,890 | 10/1975 | Frezza | 26/81 |
| 4,134,188 | 1/1979 | Bryan | 26/81 |
| 4,430,779 | 2/1984 | Rockman et al. | 26/81 |
| 4,446,632 | 5/1984 | Dornier | 34/103 |
| 4,608,767 | 9/1986 | Dornier | 34/103 |
| 4,875,260 | 10/1989 | Vecchia | 26/81 |

FOREIGN PATENT DOCUMENTS

| | | | |
|---|---|---|---|
| 1635348 | 4/1971 | Germany . | |
| 2331340 | 1/1975 | Germany . | |
| 2624439 | 12/1977 | Germany | 26/81 |
| 2811011 | 9/1979 | Germany . | |
| 553316 | 6/1977 | Russian Federation | 26/81 |

*Primary Examiner*—Amy B. Vanatta
*Attorney, Agent, or Firm*—W. F. Fasse; W. G. Fasse

[57] ABSTRACT

In a method and an apparatus for treating tubular knitted goods containing elastomeric fibers, the goods are effectively relaxed, expanded, and heat fixed or set in the desired expanded condition, while maintaining the tubular configuration of the goods and without cutting open and re-sewing the tubular configuration of the goods. The tubular knitted goods are continuously transported through a relaxing process followed by a heat fixing process and then a cooling process, while constantly maintaining the tubular structure of the goods. The goods are expanded in the radial or width direction by a tubular expander, and in the lengthwise direction by being transported between a feed roller arrangement and a draw-off roller arrangement operating at different transport velocities respectively. The temperature in the heat fixing chamber is preferably over 200° C. and the transport velocity of the tubular knitted goods can be greater than 18 m/min.

48 Claims, 9 Drawing Sheets

METHOD AND APPARATUS FOR TREATING TUBULAR KNITTED GOODS

This application is based on and claims the priority under 35 U.S.C. §119 of German Patent Applications 198 19 051.4 filed on Apr. 29, 1998, and 199 12 754.9 filed on Mar. 22, 1999. The entire disclosure of both of these German applications is incorporated herein by reference.

FIELD OF THE INVENTION

The invention relates to a method and an apparatus for treating and particularly relaxing and then heat fixing or heat setting tubular knitted goods, and especially such goods made of a first portion of natural fibers and a second portion of synthetic elastomeric fibers.

BACKGROUND INFORMATION

Tubular knitted goods made of natural fibers together with synthetic elastomeric fibers are typically subjected to a conventional treatment process in which the knitted goods are first subjected to a relaxing process, then pre-stretched or pre-tensioned, and then heat set or fixed to have a desired width.

The conventional relaxing processes involve a heat treatment at a temperature of 100 to 110° C. in order to relax the elastomeric fiber materials and ultimately achieve a uniform finished appearance and presentation of the knitted goods. Thereafter, the relaxed knitted goods are conventionally subjected to a heat setting or heat fixing of the characteristic width of the knitted goods, also known as thermosetting or thermofixing. A heat setting of the raw tubular knitted goods at a width or degree of expansion corresponding to about half of the maximum stretching range of the tubular goods is generally considered ideal. By adjusting and then fixing the width and the lengthwise extension of the raw tubular goods, suitable devices may be used to exactly prescribe and achieve the desired finished width and the desired weight per square meter of the goods.

In order to carry out the heat setting of the raw tubular goods, it has conventionally been necessary to first cut open the tubular goods along the lengthwise direction, i.e. so as to open the tubular goods into a flat single layer knitted web, which is then held under tension in a tentering frame in a flat planar condition, whereupon the heat fixing is carried out in a heat fixing apparatus. The heat fixing is carried out in the plastic deformation range of the elastomeric material of the knitted goods, namely in a temperature range of approximately 170 to 190° C., with a holding or effective time of 20 to 40 seconds.

Thereafter, according to the conventional processes, the knitted web is re-formed into a tubular configuration and the cut edges are sewed to each other to again provide a tubular material, which is then subjected to further processing, such as dyeing or coloring for example. It is important to re-form the knitted goods as a tube before carrying out the further processing in order to prevent the rolling-up of the web edges, which would lead to a non-uniform coloring or dyeing of the fabric. The conventional heat fixing process involving cutting open and re-sewing the tubular goods has been found to be rather complicated and costly in practice. Moreover, this process results in substantial waste and rejection of material, due to defects arising during the cutting-open of the tubular goods before the heat setting, and the subsequent re-sewing of the goods into a tubular form.

SUMMARY OF THE INVENTION

In view of the above, it is an object of the invention to provide a method and an apparatus for treating tubular knitted goods containing elastomeric fibers (which term includes elastomeric threads or yarns), wherein the method and apparatus can produce elastic knitted goods as the finished end product, especially without cutting open the tubular knitted goods during the processing, so that the finished product is a continuous circularly knit tubular product. The invention further aims to avoid or overcome the disadvantages of the prior art, and to achieve additional advantages, as apparent from the present specification.

The above objects have been achieved in a method of treating tubular knitted goods made of natural fibers together with synthetic elastomeric fibers, including the following steps. First, the tubular knitted goods are subjected to a relaxing step by spreading out the tubular goods in a circular or tubular expanded condition and then heat treating the goods at a first transport velocity and at a relaxing temperature substantially above normal room temperature (e.g. 25 to 30° C.) and less than the softening temperature of the elastomeric fiber material of the goods. Next, the relaxed knitted goods are fixed or set with regard to the width and length of the tubular fabric by a heat treatment at a second transport velocity and a second temperature that is sufficient to achieve the softening of the elastomeric fiber material. Finally, the knitted goods are cooled down while maintaining at least the second transport velocity, to achieve a final cooled-down temperature below the softening temperature of the elastomeric fiber material, whereby the final product is a tubular knitted fabric that has been heat fixed with regard to its width and length.

In a preferred embodiment of the invention for carrying out the above described general method according to a first aspect of the invention, the knitted goods are continuously transported at a transport velocity $v_1$ in a relaxing chamber directly before the heat fixing step. The relaxing chamber is maintained at a first temperature $T_1$, that is below the softening temperature $T_0$ of the elastomeric fiber material. The relaxing chamber is constructed similarly to the heat fixing chamber with respect to the width and length extension of the tubular knitted goods. However, an essential difference exists between the two chambers, in that the relaxing chamber is preferably heated directly by steam to achieve the preferred relaxing temperature $T_1$ between 80° C. and 110° C., or especially less than 100° C. With such a relaxing temperature, it is only necessary to provide a first transport velocity $v_1$ of preferably less than 18 m/min. Instead of the steam heating of the relaxing chamber, it is alternatively possible to use an electric, gas, or oil fired heater. Next, the heat fixing of the relaxed knitted goods is carried out at a second temperature $T_2$ and at a second transport velocity $v_2$ that is greater than the first transport velocity $v_1$. After the heat fixing step, the knitted goods are transported at a transport velocity of at least the second velocity $v_2$ while being cooled down to a cooled temperature $T_C$ below the softening temperature $T_0$ of the elastomeric fiber material. The relaxing chamber and the heat fixing chamber can directly adjoin one another, or an intermediate chamber can be arranged therebetween so as to separate the relaxing chamber from the heat fixing chamber.

The above objects have further been achieved in an apparatus for carrying out the method in connection with the first aspect of the invention as discussed above. This apparatus includes a relaxing chamber having an inlet opening and an outlet opening, a tubular internal stretcher or spreader arranged within the relaxing chamber, a feed roller arrangement situated upstream of the tubular spreader, a take-off or draw-off roller arrangement situated downstream of the tubular spreader, whereby both of these roller arrangements are independently rotationally driven, preferably a heating device connected to the relaxing chamber, a heat setting or fixing chamber arranged separately from the relaxing chamber and having an inlet opening and an outlet opening, a second tubular spreader arranged predominantly within the heat fixing chamber, a driven feed roller arrangement provided upstream of the second tubular spreader, a take-off or draw-off roller arrangement provided downstream of the second tubular spreader, a heating arrangement for generating a high temperature fluid medium, a blower for blowing the high temperature medium into the heat fixing chamber, and a cooling chamber arranged after or downstream of the outlet opening of the heat fixing chamber, wherein the second tubular spreader reaches or extends at least partially into the cooling chamber. Throughout this specification, the terms "upstream" and "downstream" should be understood as referring to directions relative to the forward transport direction of the tubular knitted goods, unless a different meaning is clear from a particular context.

A method according to a second aspect of the invention includes the following steps. First, tubular knitted goods are spread or expanded in a substantially circular tubular manner, and then the width and length of the knitted goods are fixed or set by a heat treatment at a third temperature greater than the softening temperature of the elastomeric fiber material, while being transported at a transport velocity greater than 18 m/min. To achieve this, the tubular knitted goods are preferably continuously fed into and through a heat fixing chamber, wherein the tubular goods are stretched or expanded in length and in width by using any suitable equipment therefor. The temperature $T_3$ maintained in the heat fixing chamber is preferably greater than 200° C., and the transport velocity $v_2$ of the tubular goods is preferably greater than 18 m/min. Next, the heat fixed knitted goods are cooled to a temperature that is below the softening temperature of the elastomeric fiber material, while maintaining a transport velocity of at least the second transport velocity that is more than 18 m/min.

The above objects have further been achieved in an apparatus suitable for carrying out the inventive method in connection with the above described second aspect of the invention. This apparatus generally corresponds to the apparatus described above with regard to the first aspect of the invention, but does not necessarily include the relaxing chamber and the auxiliary components associated therewith.

As a further variation of the inventive apparatus, a tubular spreader arrangement can be omitted from the relaxing chamber. Instead, a plurality of deflection elements such as deflection rollers are arranged in the relaxing chamber, so as to direct the tubular knitted goods in a looping or meandering path over the deflection elements, while the tubular knitted goods are in a collapsed or flattened configuration rather than a tubular expanded configuration. A steaming device can be arranged outside of the relaxing chamber so that the knitted goods pass through the steaming device before entering the relaxing chamber, or such a steaming device can be arranged within the relaxing chamber.

A substantial advantage achieved by the method and apparatus according to the invention is that the tubular knitted goods may be directly processed while maintaining the tubular form, i.e. while avoiding the need to cut-open and then re-sew the tubular goods as has been necessary in conventional methods. Thereby, the invention avoids additional processing steps, achieves a finished product that is a continuously circularly knitted tube without a lengthwise sewed seam, and also avoids waste resulting from defects in the cutting and the re-sewing involved in the conventional process. As a second advantage, the high fixing temperatures used according to the invention allow a high transport velocity to be used during the heat fixing step, so that the present method achieves a high throughput.

The widthwise expansion or stretching of the knitted goods is achieved by means of internal tubular spreaders of any known construction and configuration. On the other hand, the lengthwise expansion or stretching of the tubular goods is achieved by respective driven roller arrangements located upstream and downstream, or particularly above and below the tubular spreader. In order to achieve the required degree of lengthwise stretching, the upstream and downstream roller arrangements are independently driven and independently controllable in their driving speed, so that the speed difference between the faster downstream roller arrangement and the slower upstream roller arrangement leads to the required degree of lengthwise stretching.

The heating of the heat fixing chamber is achieved by blowing a high temperature fluid medium such as hot air into the chamber. The required high temperature of the medium is achieved in any known manner, for example by means of an electric, gas or oil-fired heater arrangement.

After the heat fixing step, the tubular knitted goods are maintained in a nearly circular tubular expanded configuration, and in the lengthwise stretched or extended condition, and are transported into a cooling chamber where the goods are cooled to a temperature $T_C$ below the softening temperature $T_0$ of the elastomeric fiber materials. In this manner, the knitted goods are fixed or set in the prescribed width and length condition, and thereafter, the fixed knitted goods are transported out of the apparatus.

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
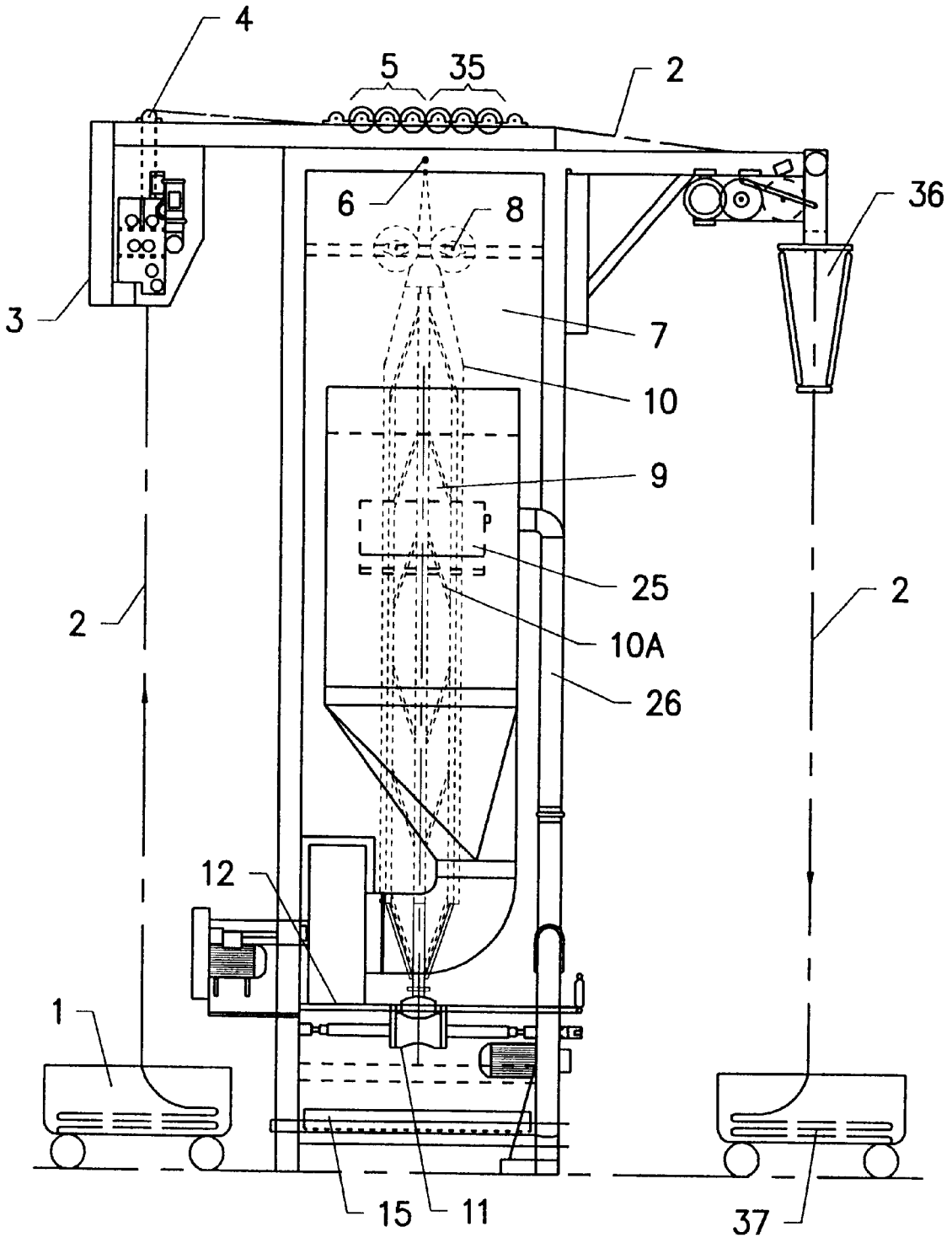
FIG. 1 is a partially sectioned side view of a first embodiment of an apparatus according to the invention including a relaxing chamber and a heat fixing chamber with a gas-fueled heating arrangement, wherein this view especially shows the relaxing chamber.

FIG. 1 shows a first embodiment of an apparatus according to the invention, wherein tubular knitted goods 2 are taken from a supply stack 1 of the raw knitted goods and are guided over a so-called inlet stretcher or spreader 3, which spreads, flattens and smoothes the knitted goods 2. Thereafter, the knitted goods 2 run over a deflection roller 4 and are then grasped or engaged by a feed roller arrangement 5 that includes rotationally driven feed rollers, which further transport the knitted goods 2 into a relaxing chamber 7.

Figure 2:
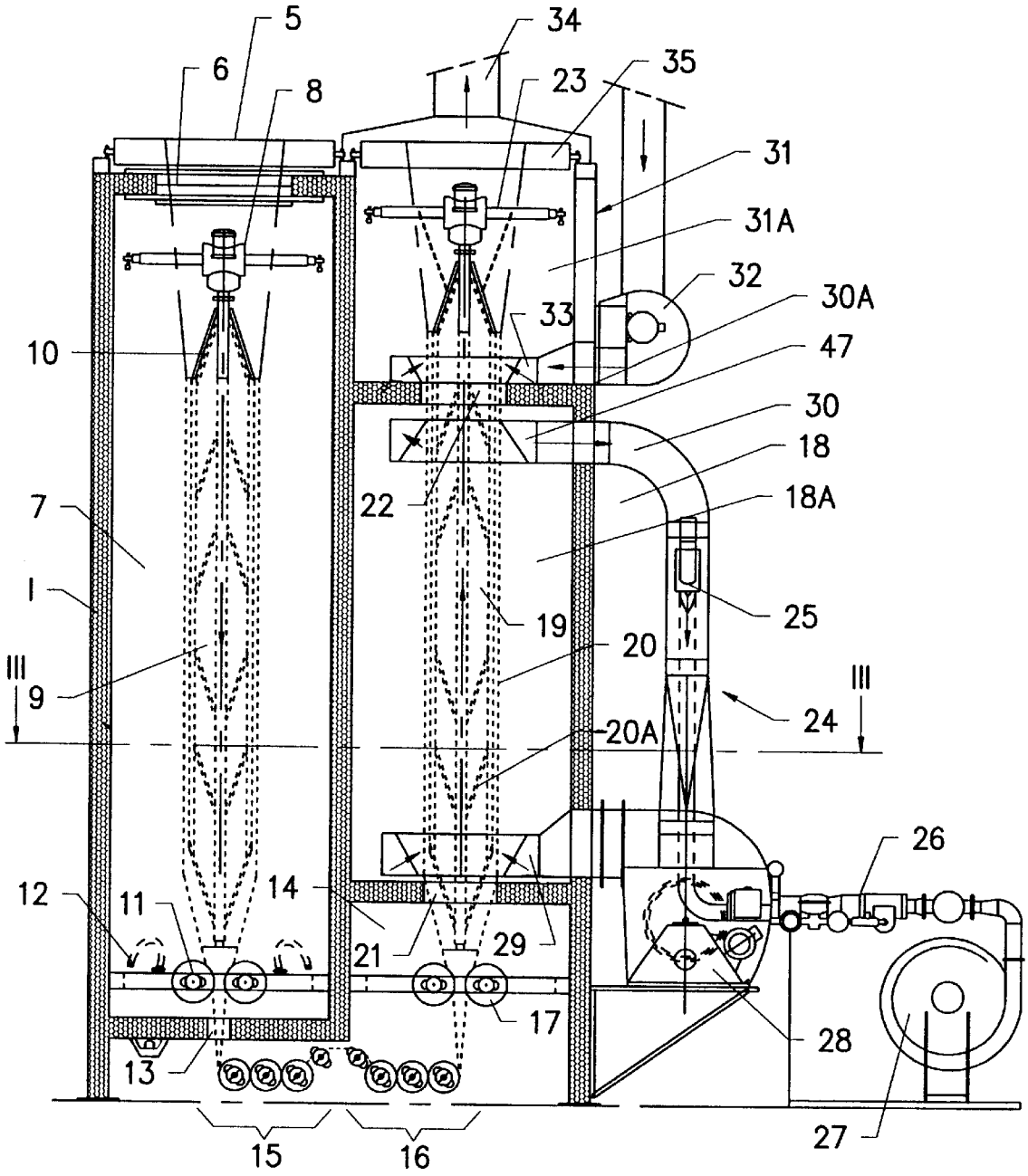
FIG. 2 is a sectioned front view of the apparatus according to FIG. 1.

The relaxing chamber 7 is insulated all around with thermal insulation I as shown in FIG. 2, for example. Furthermore, the relaxing chamber 7 has a substantially sealed inlet opening 6 through which the knitted goods 2 are introduced into the relaxing chamber 7 from the feed roller arrangement 5. The interior space of the relaxing chamber 7 is heated by a direct steam heating arrangement, whereby particularly one or more steam pipes 12 introduce steam directly into the relaxing chamber 7 through a plurality of steam introduction holes in the pipes 12. The delivery of steam is controlled to achieve the required temperature $T_1$ in a range from 80° C. to 110° C. in the relaxing chamber 7, and also provides a desired degree of moisture or humidity for facilitating the relaxing process that is to be achieved.

Due to the heat and moisture, the tubular knitted goods 2 are preheated and relaxed as they pass through the relaxing chamber 7. Moreover, the knitted goods 2 are subjected to a width expansion and particularly a circular or tubular spreading expansion by means of a tubular internal stretcher or spreader 9 arranged in the relaxing chamber 7. Particularly, the tubular spreader 9 can have any known configuration and arrangement, and may be held and located within the relaxing chamber 7 between an upper or upstream group of setting or fixing rollers 8 and a lower or downstream group of setting or fixing rollers 11.

As an example in the illustrated embodiment, the tubular spreader 9 includes a plurality of roller segments 10 respectively mounted on radially spreadable or expandable spreader arms 10A around the circumference of the tubular spreader 9. This arrangement can be seen in FIGS. 1, 2 and 3. As the tubular knitted goods 2 pass over the tubular spreader 9, i.e. with the tubular spreader 9 in the interior of the tube of knitted goods 2, the knitted goods 2 are expanded or stretched in a circular tubular fashion to a degree that depends on the particular selected extent of the radial spreading of the spreader arms 10A of the tubular spreader 9.

As shown in FIG. 2, a take-off or draw-off roller arrangement 15 is arranged in an intermediate chamber 14 downstream of the tubular spreader 9 and outside of the relaxing chamber 7. The roller arrangement 15 includes a plurality of draw-off rollers, of which at least one is rotationally driven by a drive arrangement that is not shown. Thus, the knitted goods 2 are transported off of the tubular spreader 9, through the fixing rollers 11, and through a substantially sealed outlet opening 13 of the fixing chamber 7 to come into the intermediate chamber 14 and be drawn off by the draw-off roller arrangement 15. The respective rotational speeds of the feed roller arrangement 5 and of the draw-off roller arrangement 15 are independently controllable or regulatable in an infinitely variable or stepless manner, whereby the rotational speeds of the two roller arrangements can be varied relative to each other in order to achieve a prescribed and calculated lengthwise stretching of the tubular knitted goods 2 between the feed roller arrangement 5 and the draw-off roller arrangement 15.

After the tubular knitted goods 2 have been relaxed and expanded or stretched in the relaxing chamber 7 and drawn off by the draw-off roller arrangement 15, the goods 2 pass further through the intermediate chamber 14 to a feed roller arrangement 16. From the feed roller arrangement 16, the tubular knitted goods are transported into a heat setting or fixing chamber 18 through a generally round inlet opening 21. The entire periphery of the heat fixing chamber 18 is insulated with insulation I, and a generally round outlet opening 22 is provided at the top of the chamber 18. A tubular spreader 19 including roller segments 20 mounted on adjustable spreader arms 20A is arranged within the heat fixing chamber 18, so that the bottom end of the tubular spreader 19 protrudes through the inlet opening 21 while the upper end of the tubular spreader 19 protrudes through the outlet opening 22. Accordingly, the associated lower and upper setting or fixing rollers 17 and 23 supporting the tubular spreader 19 therebetween, are also arranged outside of the heat fixing chamber 18.

Directly above the inlet opening 21, a circular or annular nozzle 29 is arranged to flow hot air at a temperature $T_3$ into the chamber 18, with the tubular spreader 19 and the tubular knitted goods 2 passing through the central opening of the annular nozzle 29. The annular flow of hot air acts as an air sluice or air curtain that surrounds the tubular knitted goods 2 being transported over the tubular spreader 19, and thereby in effect seals the chamber 18 against air exchange or flow relative to the exterior. When tubular knitted goods 2 having a relatively small tubular diameter are being treated, it is further possible to arrange cover plates or orifice plates around the tubular knitted goods, and particularly in the inlet opening 21 and the outlet opening 22, so as to provide an additional sealing effect. The hot air that is to be blown into the chamber 18 through the annular nozzle 29 is provided to the nozzle 29 from an external air shaft or duct 30 equipped with a heating arrangement 24 for heating the air, and a blower 28 for blowing the hot air through the annular nozzle 29 into the interior space 18A of the chamber 18. The heating arrangement 24, for example, includes a direct gas heater 25, which heats the air to the temperature $T_3$ in the range from 200° C. to 250° C., or for example particularly 210° C. to 250° C. The gas heater 25 is connected to a gas supply 26 that is equipped with a blower 27 that blows the gas and/or combustion air for the gas combustion.

After passing upward through the chamber 18 from the annular nozzle 29, the "used" hot air can be sucked out of the chamber 18 through an annular exhaust nozzle 47, to be recirculated through the air shaft 30, which thus operates as an exhaust air shaft as well, and forms a recirculation duct. A dust filter or the like is preferably arranged in the air shaft 30 upstream of the gas heater 25 to remove any particulate matter from the recirculated air flow.

At the top of the heat fixing chamber 18, an outlet opening 22 leads into the interior space 31A of a cooling chamber 31. In this cooling chamber 31, an annular nozzle 33 is arranged directly above the outlet opening 22, through which the tubular spreader 19 protrudes. Particularly, the upper end of the tubular spreader 19 protrudes upward through the outlet opening 22 and through the open center of the annular nozzle 33. The annular nozzle 33 blows cold air at a temperature $T_C$ below the softening temperature $T_0$ of the elastomeric fiber material of the tubular knitted goods 2. To achieve this, a blower 32 can suck ambient external air or conditioned air such as cool dry air, and blow this cool air onto the goods 2 through the annular nozzle 33. Just as the annular nozzle 29 described below, the annular cool air nozzle 33 also functions as an air curtain or air sluice to prevent substantial air exchange relative to the heat fixing chamber 18 through the outlet opening 22. The upper end of the tubular spreader 19 is supported in position by the upper fixing rollers 23 arranged above the annular nozzle 33. The "used" cold air is exhausted out of the cooling chamber 31 through an exhaust air shaft 34. If desired, this air can be re-conditioned and re-circulated to the blower 32.

The flow of cool air along the expanded tubular knitted goods 2 cools the knitted goods 2 to a temperature below the softening temperature of the elastomeric fiber component thereof, and thus sets or fixes the particular expanded condition of the knitted goods that has been achieved by the processing. The cooled knitted goods 2 are then grasped and drawn off by a draw-off roller arrangement 35 provided at the top outlet of the cooling chamber 31. The draw-off roller arrangement 35 is rotationally driven by a drive arrangement that is not shown, whereby the roller arrangement 35 transports the knitted goods 2 in a flat spread-out condition toward a fold laying or fold forming device 36 provided in the output field of the apparatus. From there, the fold-forming device 36 stacks the fully treated knitted goods 2 into a folded delivery stack 37.

The rotational drive of the draw-off roller arrangement 35 is controllable or regulatable in an infinitely variable and stepless manner, as is the feed roller arrangement 16 provided in the intermediate chamber 14. Moreover, the respective rotational speeds of these two roller arrangements 16 and 35 are adjustable and regulatable independently of each other and relative to each other in order to achieve the desired calculated lengthwise stretching of the knitted goods 2. By appropriately adjusting the rotational drives of the roller arrangements 16 and 35, and the adjustment drive for radially adjusting the degree of expansion of the expander arms 20A and the roller segments 20 of the tubular expander 19, it is possible to achieve various degrees of lengthwise expansion and widthwise expansion of the knitted goods 2, in a broad range.

In the present example embodiment, the heat fixing apparatus or heat fixing chamber 18 is equipped with a tubular spreader 19 having an effective length of about 3 meters. With that length, and the above mentioned treatment temperatures, an example heat setting duration of 7 seconds would achieve a throughput speed or transport velocity v of 25 m/min. Preferably the required holding or heating duration is less than 10 seconds, and the transport velocity out of the heat fixing chamber is at least 20 to 25 m/min. All references to transport velocities herein refer to the drawing-off velocity of the respective draw-off roller arrangement. In view of the above, it is apparent that the present embodiment achieves a high throughput speed of the goods being treated.

Figure 3:
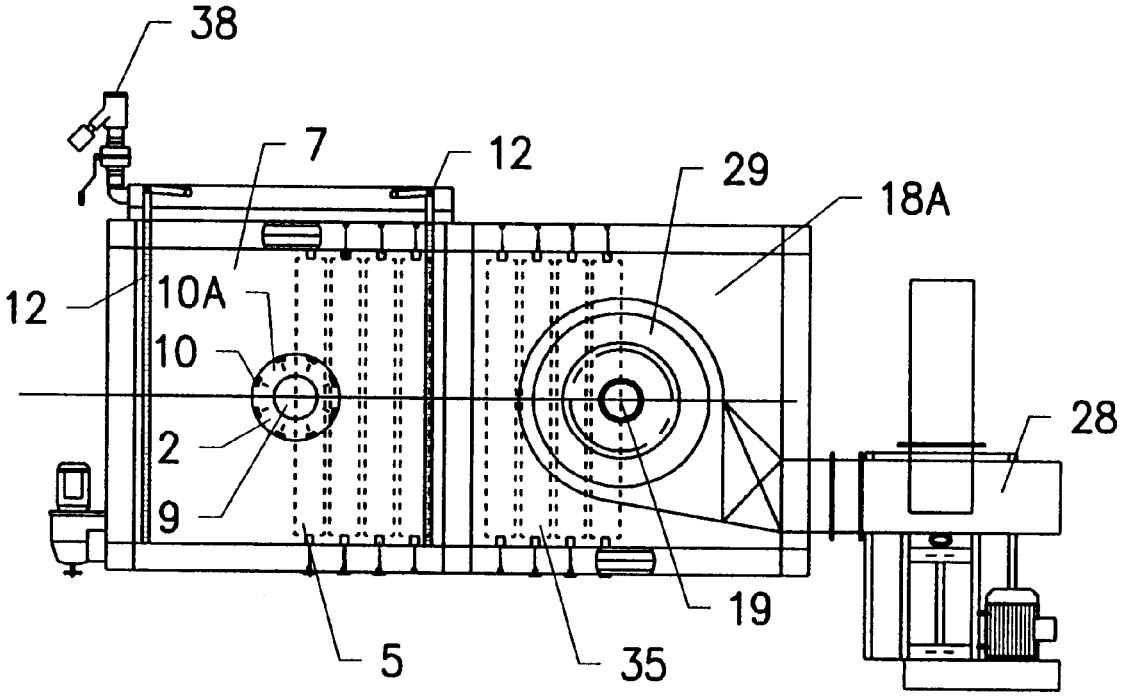
FIG. 3 is a sectional view of the apparatus according to FIG. 2, taken along section line III—III in FIG. 2.

The sectional view of FIG. 3 especially clearly shows the arrangement and configuration of the annular nozzle 29, which is arranged as a ring-shape around the tubular spreader 19 in the heat fixing chamber 18. It is also shown how the annular nozzle 29 is supplied with hot air from the blower 28 arranged outside of the heat fixing chamber 18. It is also clearly evident how the tubular spreader 9 is made up of roller segments 10 mounted on spreader arms 10A, and is arranged within the relaxing chamber 7. The spreader arms 10A are radially spreadable or adjustable so as to achieve an adjustable diameter or circumference of the tubular spreader 9, which in turn provides a selectable degree of widthwise tubular expansion of the knitted goods 2 running over the tubular expander 9. Such a tubular expander provides a substantially circular expansion of the tubular knitted goods, to the extent that the arrangement of several roller segments 10 around the periphery of the spreader approximates a circle.

Figure 4:
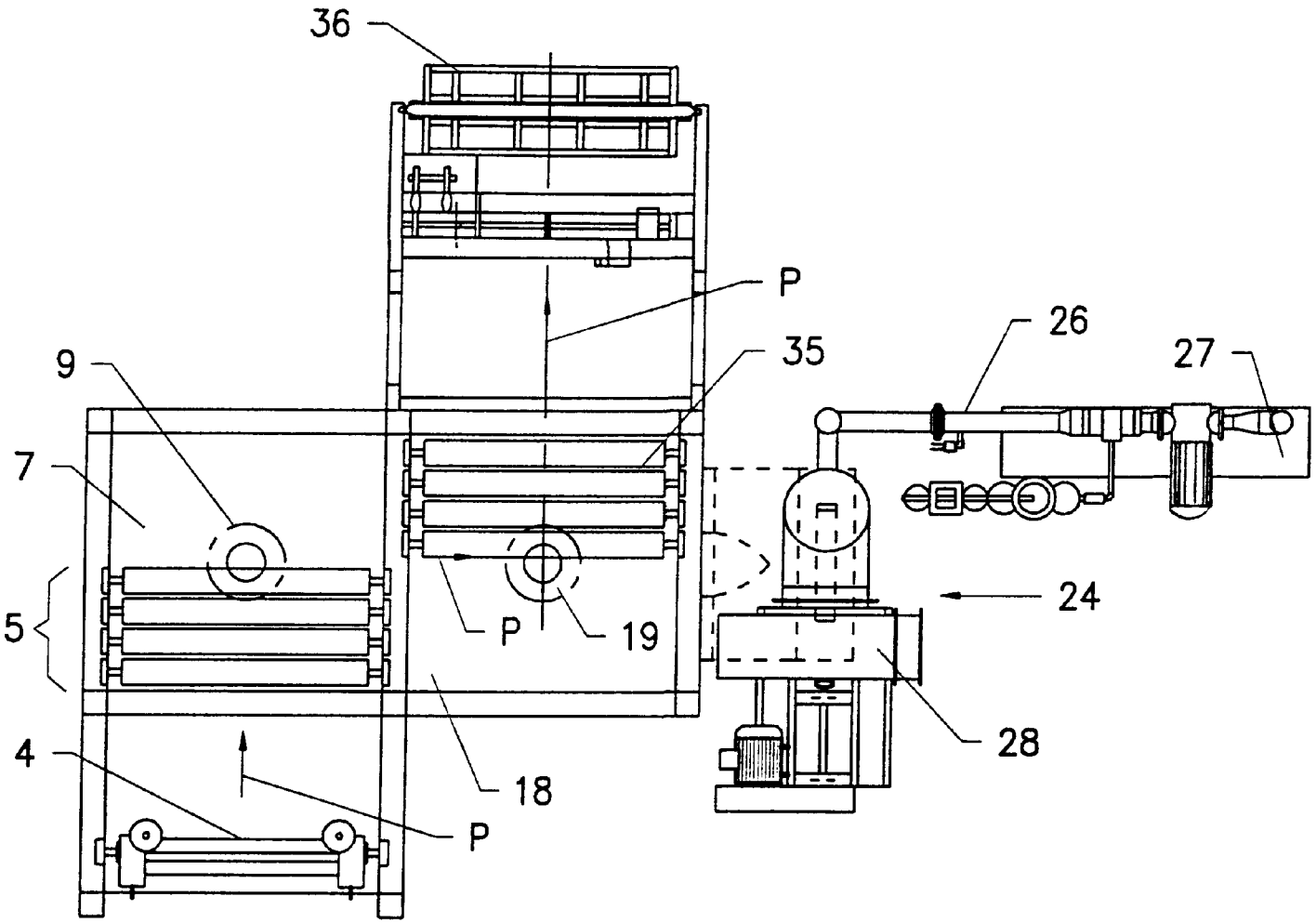
FIG. 4 is a top plan view of the apparatus according to FIG. 2.

FIG. 4 is a top view of the apparatus including the relaxing chamber 7 and the heat fixing chamber 18. This top view especially clearly shows the path followed by the knitted goods 2 through the apparatus, as shown by arrows P. Namely, the knitted goods 2 first enter the apparatus in the area of the deflection roller 4. The goods are then transported by the feed roller arrangement 5 into the relaxing chamber 7. Next, the goods run downward through the relaxing chamber 7, and back up through the heat fixing chamber 18 to the draw-off roller arrangement 35. The driven draw-off roller arrangement 35 further transports the treated goods 2 to the fold forming device 36. This top view also schematically shows the gas supply 26 for the gas heater 25, whereby the gas is delivered by a blower 27 through a pipe to the burner of the gas heater 25 (also see FIGS. 1 and 2).

Figure 5:
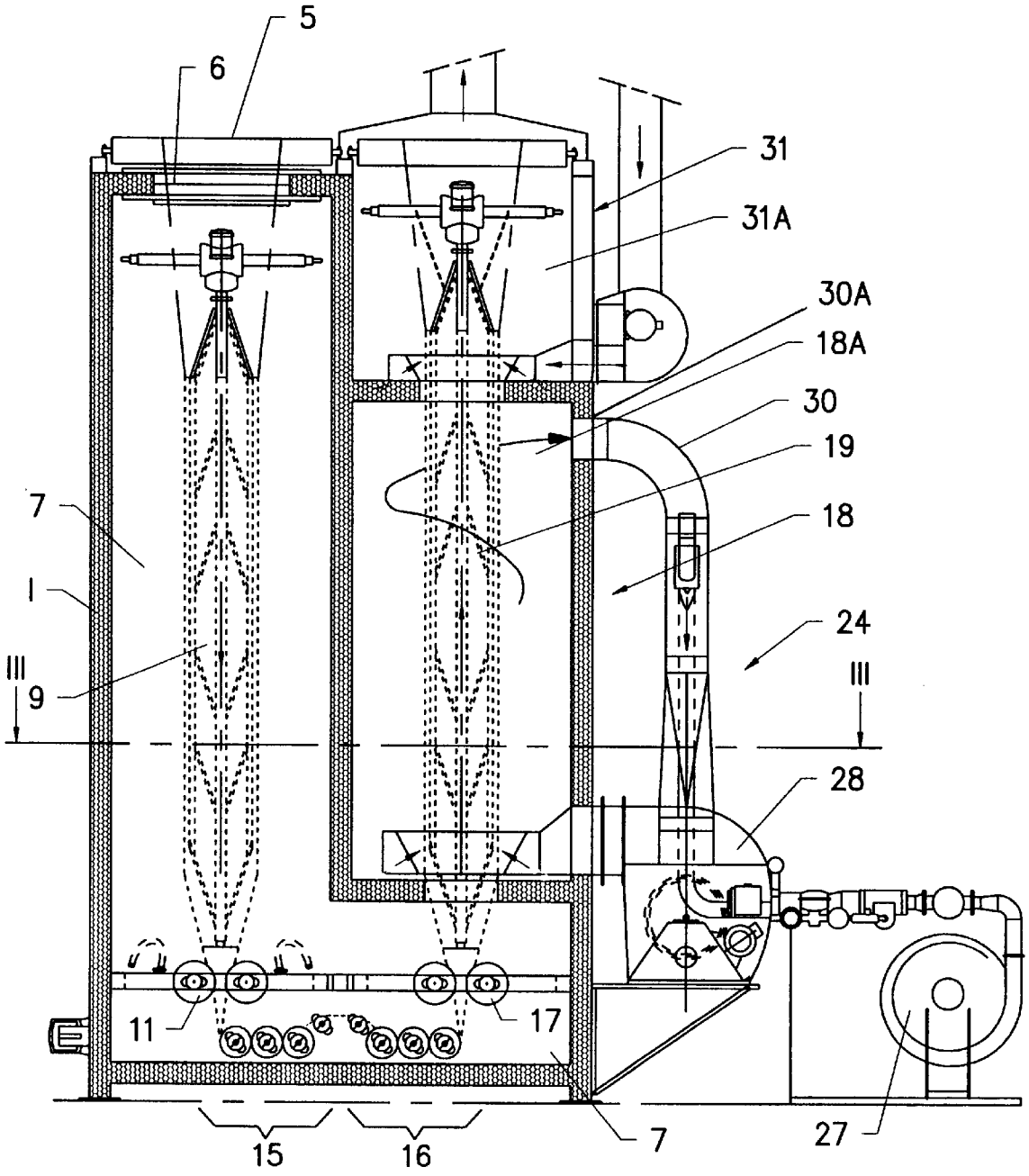
FIG. 5 is a view generally corresponding to that of FIG. 2, but showing a second embodiment including relaxing and heat fixing chambers that directly adjoin each other without an intermediate chamber.

FIG. 5 is a sectional view showing an alternative embodiment of the apparatus that generally corresponds to the above embodiment of FIG. 2. The essential difference relative to the embodiment according to FIG. 2 relates to the construction of the relaxing chamber 7. Particularly, the present embodiment does not include an intermediate chamber 14 between the relaxing chamber 7 and the heat fixing chamber 18. Instead, the entire volume occupied by the relaxing chamber 7 and intermediate chamber 14 according to FIG. 2 is now occupied entirely by the relaxing chamber 7 according to FIG. 5. Thus, the lower fixing rollers 11 and 17 supporting the bottom ends of the tubular spreaders 9 and 19, as well as the draw-off roller arrangement 15 of the relaxing chamber 7 and the feed roller arrangement 16 of the heat fixing chamber 18 are arranged in the relaxing chamber 7. In comparison to the embodiment of FIG. 2, the present embodiment of FIG. 5 achieves the advantage of a reduced heat loss between the relaxing chamber 7 and the heat fixing chamber 18. FIG. 5 also shows a simplified exhausting of the "used" hot air out of the heat fixing chamber 18 into the air shaft 30. Namely, the air shaft 30 is connected to the interior space 18A of the heat fixing chamber 18 through a simple exhaust air outlet port 30A rather than using an annular exhaust nozzle 47 as in FIG. 2.

Figure 6:
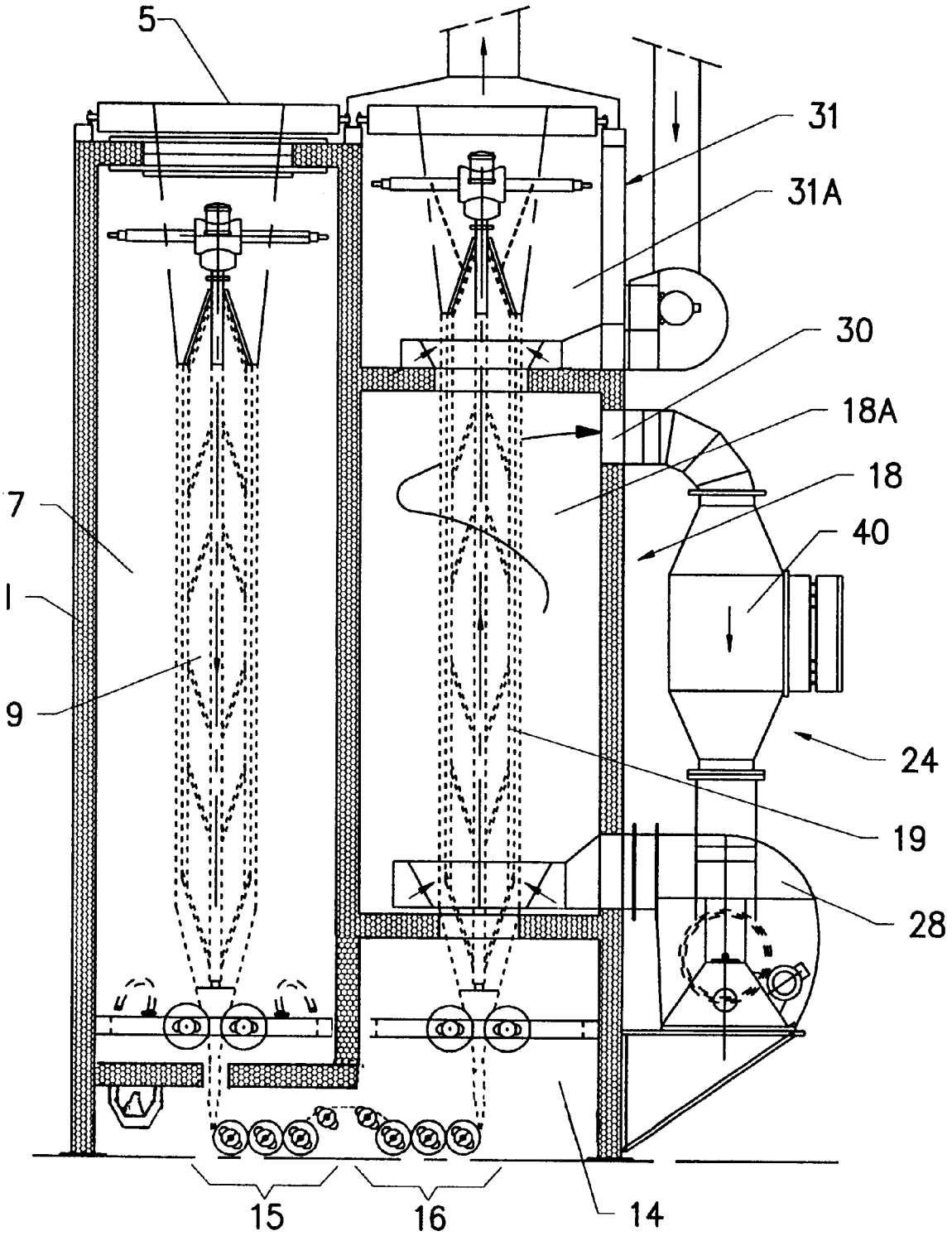
FIG. 6 is a view generally corresponding to that of FIG. 2, but showing an embodiment using an electrical heating arrangement rather than a gas-fired heating arrangement.

FIG. 6 shows a further varied embodiment that generally corresponds to that of FIG. 2, but uses a different type of heating arrangement. Specifically, the hot air for the heat fixing chamber 18 is not provided by a gas heater 25, but instead is provided by an electric heater 40. This is advantageous because the electric heater 40 provides a greater operational safety and reliability, as well as a better low-maintenance operation as compared to a gas heater. It is further advantageous in this embodiment that the relaxing chamber 7 and the heat fixing chamber 18 can be constructed and installed as a single compact plant or machine unit, or alternatively can be constructed and installed as separate machines. The use of an electric heater 40 allows great flexibility of assembly and installation.

Figure 7:
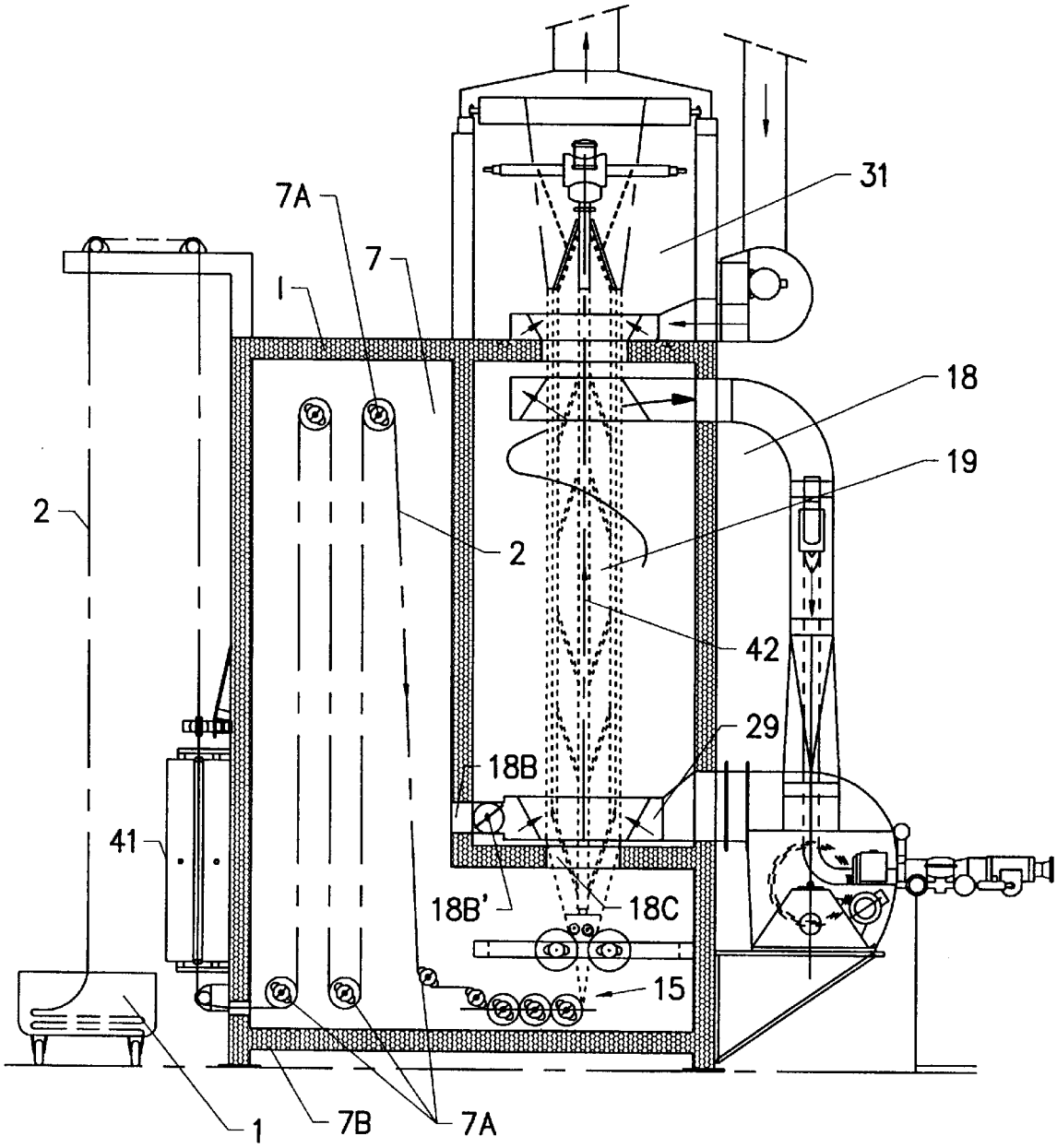
FIG. 7 is a sectional front view of a further varied embodiment of an apparatus including a steaming device for steaming the knitted goods upstream of the relaxing chamber, and using deflection rollers rather than a tubular spreader arrangement in the relaxing chamber.

FIG. 7 shows a further improved embodiment, including a heat fixing chamber 18 and a cooling chamber 31 that generally correspond to the embodiment of FIG. 2, but the equipment of the relaxing chamber 7 has been simplified. Specifically, the use of a more costly and more complicated tubular spreader 9 has been avoided, and instead the relaxing chamber 7 is equipped with a plurality of spaced-apart deflection elements 7A, for example in the form of deflection rollers. The tubular knitted goods 2 are guided over the deflection rollers 7A in a zig-zagging or meandering pattern, while the knitted goods 2 are in a flattened doubled configuration. While the goods are transported in this flattened configuration, the closed tubular knitted structure is maintained, i.e. the tubular knitted goods 2 have not been cut open in the lengthwise extension direction.

A steaming device 41 adapted to expose the flattened tubular knitted goods 2 to a steam treatment is arranged outside of and upstream of the relaxing chamber 7. The steaming device 41 can have any known configuration and construction for exposing the flattened tubular goods 2 to steam and thereby pre-relaxing the goods. From the steaming device 41, the knitted goods 2 pass through a passage opening 7B in the wall of the relaxing chamber 7 into the interior space of the relaxing chamber 7, where the goods 2 are then deflected in multiple meandering turns over the deflection rollers 7A as described above to be stretched and relaxed. From there, the goods 2 are drawn off by a draw-off roller arrangement 15 and then transported into the heat fixing chamber 18.

As shown in FIG. 5, and also in the embodiment of FIG. 7, the relaxing chamber 7 is configured generally L-shaped. The heat fixing chamber 18 adjoins the horizontally extending portion of the relaxing chamber 7 in the transport direction 42 of the tubular knitted goods 2. The bottom end of the tubular spreader 19 that protrudes into the relaxing chamber 7 opens the flatly spread tubular knitted goods 2, and thereafter the tubular knitted goods 2 are pulled through the heat fixing chamber 7 over the tubular spreader 19 in a substantially circular tubular expanded configuration, in the manner described above.

It is further noted that a hot air channel 18B with a throttle flap or damper 18B' connects the heat fixing chamber 18 or particularly the annular hot air nozzle 29 to the relaxing chamber 7. Thus, hot air is supplied in a controlled or regulated manner into the relaxing chamber 7 to achieve the required temperature therein. Also, hot air can flow from the heat fixing chamber 18 into the relaxing chamber 7 through the goods passage opening 18C in the bottom or floor of the heat fixing chamber 18.

Figure 8:
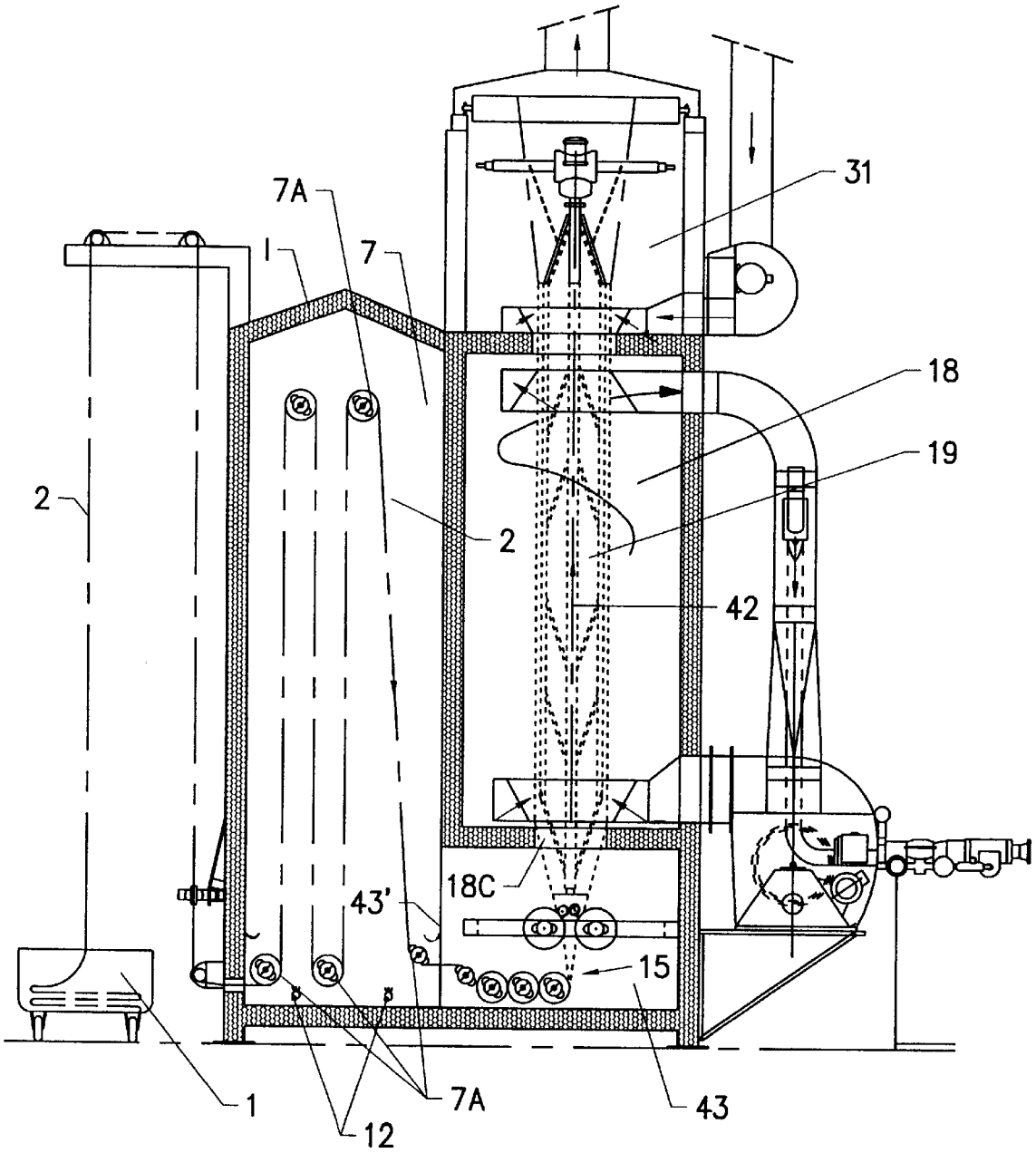
FIG. 8 is a sectional front view of an apparatus generally corresponding to that of FIG. 7, but including steam supply pipes arranged directly in the relaxing chamber rather than an external steaming device.

FIG. 8 shows another improved embodiment of an apparatus for treating tubular knit goods that generally corresponds to the embodiment of FIG. 7 and similarly avoids the use of a relatively costly and complicated tubular spreader in the relaxing chamber 7. In comparison to the embodiment of FIG. 7, the present embodiment of FIG. 8 does not use a steaming device 41 arranged before or outside of the relaxing chamber 7 in order to apply steam to the flat spread goods 2. Instead, hot steam is introduced directly into the relaxing chamber 7 through one or more steam pipes 12, and the knitted goods 2 are exposed directly to this steam in the interior space of the relaxing chamber 7.

As a further variation, the embodiment of FIG. 8 generally corresponds to that of FIG. 7, but includes a separating wall 43' forming a pre-heating chamber 43 that is at least partially separated and arranged between the relaxing chamber 7 and the heat fixing chamber 18. Thus, the knitted goods 2 that have been multiply deflected in a meandering path over deflection rollers 7A in the relaxing chamber 7 are then directed over a final deflection roller 7A to the draw-off roller arrangement 15 provided in the pre-heating chamber 43. From there, the knitted goods 2 are tubularly opened and expanded by the tubular expander 19 which is supported on rollers in the pre-heating chamber 43, and then the goods 2 are transported through the heat fixing chamber 18. The pre-heating chamber 43 is heated by hot air emanating from the heat fixing chamber 18 through the goods passage opening 18C or by means of its own separate heating arrangement. In addition to the steam introduced into the relaxing chamber 7 from the steam pipes 12, additional heat may flow in the form of hot air from the pre-heating chamber 43 into the relaxing chamber 7.

Figure 9:
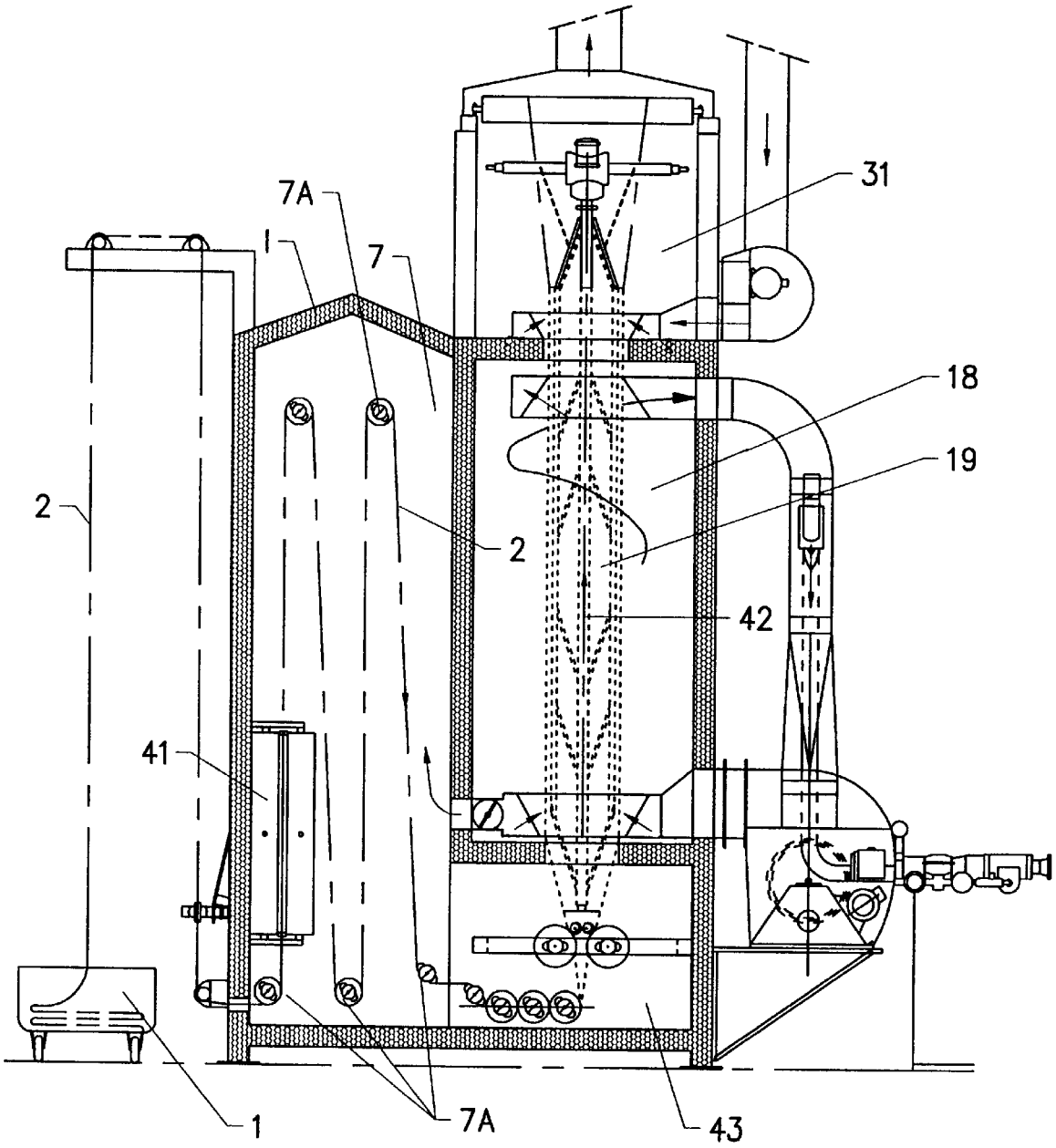
FIG. 9 is a sectional front view generally corresponding to FIG. 7, but having a steaming device arranged within the relaxing chamber.

FIG. 9 shows yet another variation of an apparatus according to the invention that generally corresponds to the embodiments of FIGS. 7 and 8, and especially the embodiment of FIG. 7 with respect to the relaxing chamber 7. However, in comparison to the embodiment of FIG. 7, a steaming device 41 is not arranged outside of and upstream of the relaxing chamber 7, but rather such a steaming device 41 is arranged directly within the relaxing chamber 7. Thus, the flattened, doubled tubular knitted goods 2 are introduced into the relaxing chamber 7, and then pass through the steaming device 41 to be subjected to a steam treatment. This embodiment provides improved thermal efficiency as compared to the embodiment of FIG. 7, because the waste or emitted heat of the steaming device 41 directly heats the relaxing chamber 7. Additional hot air may be provided into the relaxing chamber 7 through a hot air duct equipped with a damper as described above in connection with FIG. 7.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of treating tubular knitted goods containing elastomeric fibers having a characteristic softening temperature ($T_0$) comprising the following steps in sequence:

a) expanding said tubular knitted goods into a substantially circular tubular configuration;

b) exposing said tubular knitted goods in said expanded tubular configuration to a heating temperature ($T_2$, $T_3$) that is greater than said characteristic softening temperature ($T_0$) of said elastomeric fibers, while transporting said tubular knitted goods at a heating transport velocity ($v_2$); and c) cooling said tubular knitted goods to a cooled temperature ($T_C$) that is below said characteristic softening temperature ($T_0$) of said elastomeric fibers, while transporting said tubular knitted goods at a cooling transport velocity ($v_C$)

at least equal to said heating transport velocity ($v_2$); wherein said steps a), b) and c) together result in said tubular knitted goods being fixed to have a specified width and length.

2. The method according to claim 1, wherein said tubular knitted goods contain a first portion of said elastomeric fibers and further contain a second portion of natural fibers.

3. The method according to claim 1, expressly excluding any step of cutting open said tubular knitted goods along a lengthwise extension direction thereof, and wherein all said steps of said method are carried out while maintaining said tubular knitted goods in an unbroken tubular configuration.

4. The method according to claim 1, wherein said heating transport velocity ($v_2$) is greater than 18 m/min.

5. The method according to claim 4, wherein said heating temperature ($T_2$, $T_3$) is at least 200° C.

6. The method according to claim 4, wherein said heating temperature ($T_2$, $T_3$) is in a range from 210° C. to 250° C.

7. The method according to claim 4, wherein said heating transport velocity ($v_2$) is in a range from 20 to 25 m/min.

8. The method according to claim 1, wherein said step b) further comprises stretching said tubular knitted goods simultaneously in length and in width in said expanded tubular configuration while exposing said tubular knitted goods to said heating temperature ($T_2$, $T_3$).

9. The method according to claim 8, wherein said stretching of said tubular knitted goods in width comprises passing said tubular knitted goods around and over a tubular expander that has an outer circumference larger than a circumference of said tubular knitted goods before said stretching in width.

10. The method according to claim 8, wherein said stretching of said tubular knitted goods in length comprises pulling said tubular knitted goods with a draw-off roller arrangement at said heating transport velocity ($v_2$), and feeding said tubular knitted goods with a feed roller arrangement at a feed transport velocity less than said heating transport velocity, while carrying out said step of exposing said tubular knitted goods to said heating temperature between said feed roller arrangement and said draw-off roller arrangement, and wherein said feed roller arrangement and said draw-off roller arrangement are independently operated at independent rotational speeds.

11. The method according to claim 1, wherein said step of exposing said tubular knitted goods to said heating temperature ($T_2$, $T_3$) comprises flowing a hot fluid medium at said heating temperature ($T_2$, $T_3$) along said tubular knitted goods in said expanded tubular configuration.

12. The method according to claim 1, wherein said stop of cooling said tubular knitted goods comprises flowing a cool fluid medium at or below said cooled temperature ($T_C$) along said tubular knitted goods.

13. The method according to claim 1, wherein said step c) further comprises maintaining said expanded tubular configuration of said tubular knitted goods from said step b) into said step c) and during at least part of said cooling.

14. The method according to claim 1, wherein said heating transport velocity ($v_2$) is less than or equal to 18 m/min.

15. The method according to claim 14, wherein said heating temperature ($T_2$, $T_3$) is less than 200° C.

16. The method according to claim 15, wherein said heating temperature ($T_2$, $T_3$) is greater than 190° C.

17. The method according to claim 1, further comprising a preliminary step before said step b), of relaxing said tubular knitted goods by exposing said tubular knitted goods to a relaxing temperature ($T_1$) that is greater than normal room temperature and below said characteristic softening temperature ($T_0$) of said elastomeric fibers, while transporting said tubular knitted goods at a relaxing transport velocity ($v_1$).

18. The method according to claim 17, wherein said preliminary step of relaxing said tubular knitted goods is carried out after said step a), and wherein said relaxing is carried out with said tubular knitted goods in said expanded tubular configuration.

19. The method according to claim 18, further comprising collapsing said tubular knitted goods from said expanded tubular configuration to a collapsed flat configuration after said relaxing, and further comprising another step of re-expanding said tubular knitted goods to an expanded tubular configuration after said collapsing and before said step b).

20. The method according to claim 17, wherein said preliminary step of relaxing said tubular knitted goods is carried out before said step a) while maintaining said tubular knitted goods in a collapsed flat configuration.

21. The method according to claim 17, wherein said relaxing temperature ($T_1$) is in a range from 80° C. to 110° C.

22. The method according to claim 21, wherein said relaxing temperature ($T_1$) is less than 100° C.

23. The method according to claim 17, wherein said heating transport velocity ($v_2$) is greater than said relaxing transport velocity ($v_1$).

24. The method according to claim 17, wherein said heating transport velocity ($v_2$) is greater than 18 m/min. and said relaxing transport velocity ($v_1$) is less than 18 m/min.

25. The method according to claim 17, wherein said step of exposing said tubular knitted goods to said relaxing temperature ($T_1$) comprises applying a hot water steam to said tubular knitted goods at a temperature of at least said relaxing temperature.

26. The method according to claim 17, further comprising, before said preliminary step of relaxing said tubular knitted goods, a step of pre-heating and pre-relaxing said tubular knitted goods by applying steam to said tubular knitted goods.

27. The method according to claim 17, wherein said preliminary step further comprises altering a length of said tubular knitted goods during said relaxing.

28. The method according to claim 27, wherein said preliminary step further comprises altering a tubular circumference of said tubular knitted goods during said relaxing.

29. An apparatus for treating tubular knitted goods comprising:

a heat fixing chamber having an inlet opening and an outlet opening respectively adapted to allow said tubular knitted goods to be transported therethrough;

a tubular spreader device arranged predominantly within said heat fixing chamber and adapted to be positioned inside said tubular knitted goods with said goods passing thereover;

a rotationally driven feed roller arrangement arranged upstream of said tubular spreader device;

a rotationally driven draw-off roller arrangement arranged downstream of said tubular spreader device;

a heating arrangement that is adapted to heat a fluid medium and that is connected to a duct;

a blower connected to said duct in series with said heating arrangement and further connected to said heat fixing chamber and adapted to blow said fluid medium into said heat fixing chamber; and a cooling chamber connected to said heat fixing chamber for communication therebetween through said outlet opening of said chamber;

wherein an end portion of said tubular spreader device protrudes out of said heat fixing chamber through said outlet opening and into said cooling chamber.

30. The apparatus according to claim 29, wherein said heating arrangement comprises an oil- or gas-fired heater.

31. The apparatus according to claim 29, wherein said heating arrangement comprises an electric heater.

32. The apparatus according to claim 29, further comprising a ring-shaped annular nozzle that is connected to said duct and that is arranged within said heat fixing chamber circularly surrounding said tubular spreader device proximate said inlet opening.

33. The apparatus according to claim 29, further comprising a ring-shaped annular nozzle that is arranged within said cooling chamber circularly surrounding said end portion of said tubular spreader device, and a blower that is connected to said ring-shaped nozzle and that is adapted to blow a cooling medium through said ring-shaped nozzle into said cooling chamber.

34. The apparatus according to claim 29, further comprising:

a relaxing chamber that is separated from said heat fixing chamber and that has an inlet opening and an outlet opening respectively adapted to allow said tubular knitted goods to be transported therethrough, a spreader arrangement arranged within said relaxing chamber;

another rotationally driven feed roller arrangement arranged upstream of said spreader arrangement;

another rotationally driven draw-off roller arrangement arranged downstream of said spreader arrangement; and a source of heat adapted to provide heat into said relaxing chamber.

35. The apparatus according to claim 34, further comprising an intermediate chamber interposed and connected between said outlet opening of said relaxing chamber and said inlet opening of said heat fixing chamber.

36. The apparatus according to claim 35, wherein said another draw-off roller arrangement associated with said relaxing chamber and said feed roller arrangement associated with said heat fixing chamber are arranged within said intermediate chamber.

37. The apparatus according to claim 35, wherein said another draw-off roller arrangement associated with said relaxing chamber and said feed roller arrangement associated with said heat fixing chamber are arranged within said relaxing chamber.

38. The apparatus according to claim 34, wherein said relaxing chamber is directly connected to said heat fixing chamber without an intermediate chamber therebetween, so that said outlet opening of said relaxing chamber transitions directly into said inlet opening of said heat fixing chamber.

39. The apparatus according to claim 38, wherein said another draw-off roller arrangement associated with said relaxing chamber and said feed roller arrangement associated with said heat fixing chamber are arranged within said relaxing chamber.

40. The apparatus according to claim 34, wherein said spreader arrangement comprises another tubular spreader device arranged within said relaxing chamber and adapted to be positioned inside said tubular knitted goods with said goods passing thereover, and wherein said feed roller arrangements and said draw-off roller arrangements are each rotationally driveable and controllable independently of the others.

41. The apparatus according to claim 34, wherein said spreader arrangement comprises a plurality of deflection elements that are spaced apart from one another inside said relaxing chamber and that are adapted to have said tubular knitted goods deflected sequentially over said deflection elements in a meandering pattern while said knitted goods are in a flat collapsed configuration.

42. The apparatus according to claim 41, wherein said source of heat at least includes a steaming device arranged within said relaxing chamber and adapted to have said knitted goods transported therethrough to apply steam to said knitted goods.

43. The apparatus according to claim 41, further comprising a steaming device arranged outside of said relaxing chamber upstream of said inlet opening of said relaxing chamber, and being adapted to have said knitted goods transported therethrough to apply steam to said knitted goods.

44. The apparatus according to claim 34, wherein said source of heat comprises a steam supply pipe arranged in said relaxing chamber and adapted to emit steam directly into said relaxing chamber.

45. The apparatus according to claim 44, further comprising a separate pre-heating chamber interposed and connected between said relaxing chamber and said heat fixing chamber.

46. The apparatus according to claim 34, wherein said source of heat comprises a hot medium duct leading from said heat fixing chamber to said relaxing chamber, with an adjustable damper in said hot medium duct.

47. The apparatus according to claim 34, further comprising first support rollers that respectively support upper and lower ends of said spreader arrangement and that are arranged within said relaxing chamber, and second support rollers that respectively support upper and lower ends of said tubular spreader device and that are arranged outside of said heat fixing chamber.

48. An apparatus for treating tubular knitted goods comprising:

first means for relaxing said tubular knitted goods by exposing said goods to steam while maintaining said goods in an uncut continuous tubular configuration;

second means, arranged downstream of said first means, for expanding said goods in a circumferential direction and elongating said goods in a lengthwise direction while heating said goods and while maintaining said goods in said uncut continuous tubular configuration; and third means, arranged downstream of said second means, for cooling said goods while maintaining said goods in said uncut continuous tubular configuration.

* * * * *